US006532764B1

(12) United States Patent
Hirota et al.

(10) Patent No.: US 6,532,764 B1
(45) Date of Patent: Mar. 18, 2003

(54) DEGREE OF SUPERCOOLING CONTROL TYPE EXPANSION VALVE

(75) Inventors: Hisatoshi Hirota, Tokyo (JP); Shinji Saeki, Tokyo (JP); Tokumi Tsugawa, Tokyo (JP); Yuusuke Inoue, Tokyo (JP); Katsumi Koyama, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/390,152

(22) Filed: Sep. 3, 1999

(30) Foreign Application Priority Data

Sep. 18, 1998 (JP) ..... 10-264851
Jan. 28, 1999 (JP) ..... 11-019513

(51) Int. Cl.[7] ..... F25B 41/06
(52) U.S. Cl. ..... 62/527; 62/528
(58) Field of Search ..... 62/527, 528, 511; 137/543.23, 539, 453.21; 251/366, 129.18

(56) References Cited

U.S. PATENT DOCUMENTS 1,687,209 A * 10/1928 Holmes ..... 137/543.23
3,387,625 A * 6/1965 Laure ..... 137/539
3,805,824 A 4/1974 Robbins ..... 137/504
3,943,969 A * 3/1976 Rubin et al. ..... 137/543.23
4,066,096 A 1/1978 Lind, Jr. ..... 137/504
4,545,405 A * 10/1985 LaBelle ..... 137/540
4,932,429 A * 6/1990 Watanabe et al. ..... 137/468
5,004,008 A 4/1991 Drucker ..... 137/504
5,139,047 A * 8/1992 Reinicke ..... 137/543.21
5,161,572 A * 11/1992 Oberi et al. ..... 137/543.23
5,170,638 A * 12/1992 Koening et al. ..... 62/528
5,332,000 A * 7/1994 Gassner ..... 137/543.23

FOREIGN PATENT DOCUMENTS

| | | |
|---|---|---|
| CH | 285258 | 8/1952 |
| EP | 0255035 | 2/1988 |
| JP | 56-7959 | 1/1981 |

* cited by examiner

*Primary Examiner*—William E. Tapolcai
*Assistant Examiner*—Mohammad M. Ali
(74) *Attorney, Agent, or Firm*—Patterson, Thuente, Skaar & Christensen LLC

(57) ABSTRACT

An expansion valve of the degree-of-supercooling control type can be easily adjusted when assembling the degree of supercooling of a high-pressure refrigerant control to be held constant if an exerting force adjusting member is used for finely adjusting the exerting force. If either a throttling portion or a valve seat is formed with the exerting force adjusting member, a simple and compact design or construction can be achieved.

9 Claims, 4 Drawing Sheets

DEGREE OF SUPERCOOLING CONTROL TYPE EXPANSION VALVE

BACKGROUND OF THE INVENTION

1. Field of the Invention

The invention relates to a degree-of-supercooling control type expansion valve upstream of an evaporator in a refrigerating cycle and containing a valve seat, a valve body, a throttling portion and a force exerting means biasing said valve body towards said valve seat, according to the preamble part of claim 1 and to the preamble part of independent claim 2.

A conventionally used expansion valve in a refrigerating cycle is a so-called temperature type expansion valve controlling the discharge of a refrigerant entering an evaporator in response to the temperature and the pressure of a low-pressure refrigerant discharge from the evaporator.

2. Description of the Related Art

Instead of a temperature type expansion valve and disclosed in Laid-Open JP-application SHO 56-7959 an expansion valve of a degree-of-supercooling control type can be used. Said expansion valve is designed with a simple configuration and is able to constantly control the degree-of-supercooling of the high-pressure refrigerant. This allows to achieve a very simple, compact configuration of the valve and the refrigerating cycle. However, said known expansion valve of the degree-of-supercooling control type has a drawback because the degree-of-supercooling cannot be adjusted finely when the valve is assembled, which degree-of-supercooling, however, must be kept constant, e.g. in a series of production of a identical valves of said type.

OBJECTS AND SUMMARY OF THE INVENTION

It is an object of the present invention to provide an expansion valve of the degree-of-supercooling control type which can be finely adjusted when being assembled in order to keep the degree-of-supercooling of a high-pressure refrigerant constant and without losing the simplicity and compactness of the construction.

The above-mentioned object can be achieved by providing an exerting force adjusting member for finely adjusting the exerting force and by forming either the throttling portion or the valve seat structurally with the exerting force adjusting member. Said exerting force adjusting member is provided such that it allows to adjust the exerting force either during assembly or even after assembly of the expansion valve in a series of such expansion valve having identical structural features. Said adjustment can be carried out in order to keep the degree-of-supercooling of a high-pressure refrigerant constant, e.g. among a series of identical expansion valves.

In case that said exerting force adjusting member simultaneously is forming said valve seat, it does indirectly support said force exerting means via said valve body.

In case that said exertion force adjustment member simultaneously is forming said valve seat, said throttling portion is formed with said valve body co-operating with said valve seat. In both cases said exerting force adjusting member is carrying out a dual function, while in the second case even the valve body is carrying out a dual function. As a result the overall design is simplified. The dimensions of the expansion valve can be kept compact.

Alternatively, with said valve seat formed with said exerting force adjusting member said counterfort is formed with said throttling portion. Also in this case, both components carry out dual function.

Alternatively, with said throttling portion formed with said exerting force adjusting member said counterfort is formed with said valve seat. Again, said counterfort and said force exerting adjusting member fulfil dual functions and allow to achieve a compact and structurally simple design.

According to a further aspect of the invention both said exerting force adjusting member and said counterfort are formed with a respective valve seat and two opposed valve bodies are associated to both valve seats so that both valve bodies are biased in opposite directions by a common force exerting means and both valve bodies being formed with respective throttling portions. In this case both valve seats are located oppositely with a certain intermediate distance between them. A controlled flow in both directions is possible, which might be desirable e.g. for a refrigerating cycle also used as a heating cycle. This design results in a bi-directional expansion valve.

In the latter case it is desirable to have check valves restricting the inflow of refrigerant from the external side into the expansion valve. Structurally simple said check valves are integrated into the throttling portions wherein the throttle openings simultaneously constitute valve seats for the check valves.

Said force exerting means can be at least one spring. Advantageously, said spring is made from a shape memorising alloy providing a temperature depending variable spring constant. Of particular advantage is if the spring is responsive to a temperature rise in the refrigerant by a spring constant increase. This leads to the positive effect that the degree-of-supercooling as controlled constantly increases when a load for the refrigerating cycle is large and consequently the temperature of the refrigerant starts to rise. Thereby, the cooling power increases permitting the adaptation of the cooling effect to the outside condition.

Expediently the force exerting adjusting member is threadably received in the refrigerant passage. This allows to gradually adjust the exerting force or to steplessly vary the pre-load of the force exerting means.

Alternatively, said exerting force adjusting member can be positioned by a press-fit in axial direction within the refrigerant passage in the proper position in order to adjust the exerting force to a desired value.

Finally, said throttling portion, which conventionally is a through bore, instead may be shaped with an annular or ring-shaped cross-section. Having the same throttling factor across the throttling portion a ring-shaped throttling portion is providing an enlarged contact surface for the refrigerant leading to the positive effect of a greatly reduced passing sound of the refrigerant. A ring-shaped throttling portion avoids the formation of an undesirable operation noise source. Said ring-shaped cross-section can be formed by discrete ring segments or with a continuous ring shape.

BRIEF DESCRIPTION OF THE DRAWINGS

Embodiments of the inventions will be described with the help of the drawings. In the drawings is.

DESCRIPTION OF THE PREFERRED EMBODIMENTS

Figure 1:
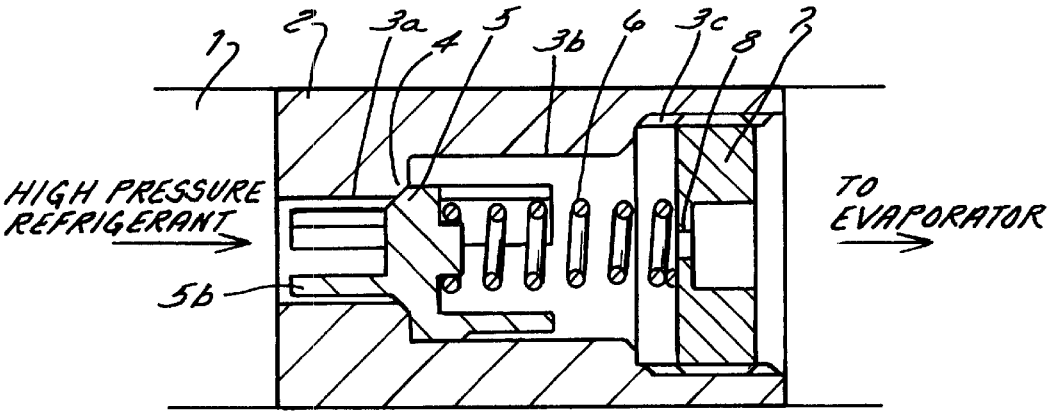
FIG. 1A longitudinal section of an expansion valve of the degree-of-supercooling control type, corresponding to a first embodiment, FIG. 2A longitudinal section of a second embodiment, FIG. 3A longitudinal section of a third embodiment, FIG. 4A longitudinal section of a fourth embodiment.

In FIG. 1 in the middle of a refrigerant line 1 of a refrigerating cycle of a cooling equipment for an automobile (not shown in detail) a stepped cylindrical body 2 is fixedly arranged. Said cylindrical body 2 is designed to allow that a high-pressure refrigerant flows from the upstream side (left) to the downstream side (right) and into a not shown evaporator. At an edge portion of the mouth of a refrigerant passage hole 3*a* a valve seat 4 is formed at the inlet side of cylindrical body 2. A valve body 5 is arranged oppositely to valve seat 4 in a state in which valve body 5 is exerted from the downstream side by the exciting force of a compression coil spring defining a force exerting means 6. With a balance between the pressure difference of the refrigerant pressure from the upstream side to the downstream side of valve seat 4 and the force of spring 6, valve body 5 is separated from valve seat 4 in order to control the discharge of refrigerant passing the refrigerant line 1.

Valve body 5 has a circular conical surface facing valve seat 4 and is loosely fitted to refrigerant passage hole 3*b* by means of e.g. three foot pieces 5*b* projecting from valve body 5 and entering refrigerant passage hole 3*b* e.g. in order to guide valve body 5 during its movements in relation to valve seat 4. Valve seat 4 is shown as a conical valve seat. At the downstream side of valve body 5, e.g. three foot pieces 5*a* protrude from valve body 5. Foot pieces 5a are arranged along the inner periphery of refrigerant passage hole 3*b,* e.g. in order to also guide valve body 5 during its operational movement. As a result, vibrations of valve body 5 due to the dynamic behaviour of a refrigerant flow is suppressed greatly. Noise generation by valve body 5 is avoided or at least suppressed to a large extent.

At the downstream end side of cylindrical body 2 and internal thread portion 3*c* is formed. An exerting force adjusting member 7 formed as a nut in this embodiment and having an external thread is threadably received in internal thread portion 3*c.* Compression coil spring 6 directly abuts against member 7. The other end of spring 6 is abutting the rear side of valve body 5 within a cavity confined by foot pieces 5*a.* During assembly, or even after assembly, of the expansion valve the exerted force of the compression coil spring 6 applied to valve body 5 can be finely adjusted arbitrarily.

For example, in the centre line of member 7 a refrigerant passage hole is drilled defining a throttling portion 8 for generating an adiabatic expansion to the passing refrigerant. Said throttling portion 8 at least partially is formed very thin in order to define a flow restrictor. To the downstream side of the expansion valve a not shown evaporator is connected. The refrigerant passing throttling portion 8 is sent to the evaporator while being subjected to an adiabatic expansion.

The high-pressure refrigerant at the upstream side of valve seat 4 is a liquid in supercooled state. The refrigerant looses supercooling due to foams occurring within the liquid after passing through the operating nip between valve seat 4 and valve body 5. Therefore, if the degree-of-supercooling of high-pressure refrigerant at the upstream side is lowered, the amount of foam in the refrigerant downstream of valve seat 4 is increasing, and, as a result, the discharge of refrigerant is decreasing as well, and the degree-of-supercooling of the refrigerant at the upstream side is increasing again.

To the contrary, if the degree-of-supercooling of the high-pressure refrigerant at the upstream side of expansion valve rises, the foam amount in the refrigerant downstream of valve seat 4 is decreasing, and, as a result, the discharge amount of refrigerant is increasing. As a consequence, the degree-of-supercooling of the refrigerant at the upstream side is lowered. By operations of valve seat 4, and valve body 5, the degree-of-supercooling of the high-pressure refrigerant at the upstream side can be maintained constant.

By threading exerting force adjusting member 7 inside cylindrical body 2 further inwardly or outwardly, the exerting force of spring 6 can be changed, e.g. during assembly of the expansion valve. In this way the magnitude of the degree-of-supercooling of the high-pressure refrigerant which degree is to be maintained constant can be finely adjusted arbitrarily. Moreover, forming throttling portion 8 in member 7 leads to an extremely simple and compact configuration.

In all embodiments as shown and described, it might be advantageous to coat the throttling portion 8 with a material having good lubricity. A suitable material might be ethylene tetrafluoride resin. Instead a part could be inserted into member 7 forming throttling portion 8 of such material. As a further alternative, member 7 entirely could be formed of such material. With the good lubricating effect of said material clogging of the throttling portion 8 due to sticking of sludge contained in the refrigerant can be prevented.

Figure 2:
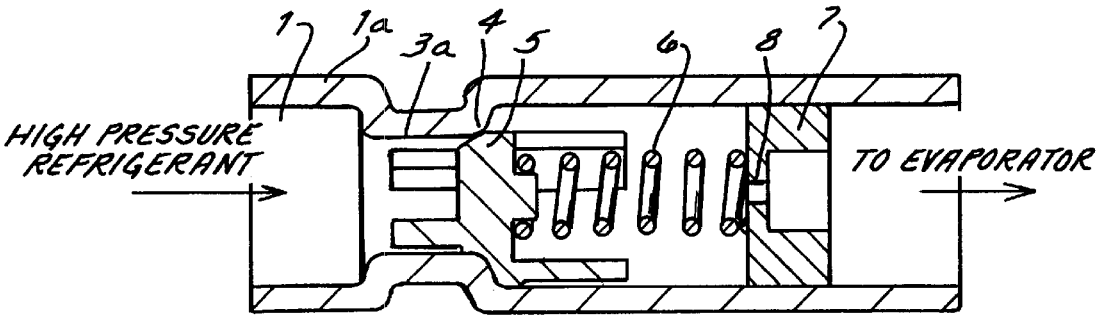

In the embodiment of the expansion valve as shown in FIG. 2 refrigerant passage hole 3*a* and valve seat 4 both are formed by a narrowed section of a pipe 1*a* of the refrigerant line 1 (pressing deformation of the pipe). Exerting force adjusting member 7 in this embodiment is disk-shaped and is a press-in member pressed into pipe 1*a* into a suitable axial position, e.g. during assembly of the expansion valve, and is fixed to the inner periphery of pipe 1*a.*

The degree-of-supercooling finally can be adjusted depending on the axial position of member 7 by solely pressing member 7 into the right position. No threading work is required and a simpler, more compact configuration can be achieved.

Figure 3:
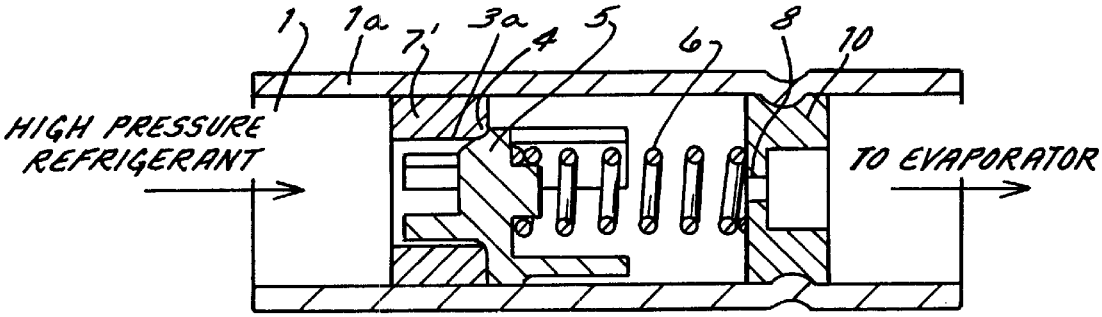

In the embodiment of the expansion valve shown in FIG. 3 exerting force adjusting member 7' is in the form of a cylindrical member in which the refrigerant passage hole 3*a* at the inlet side and valve seat 4 at the outlet side are integrally formed. Member 10 is pressed in and fixed to the inner periphery of pipe 1*a* of the refrigerant line 1. As a fixed counterfort 10 for spring 6 a disk-shaped member is axially fixed in its position, e.g. by caulking pipe 1*a*, and with a certain axial distance from member 7' which distance suffices to receive valve body 5 and spring 6. Member 7' indirectly supports the force of spring 6 via valve body 5. Counterfort 10 is formed with throttling portion 8 in the form of a central through bore.

The degree-of-supercooling finely can be adjusted by selecting the position of member 7' when pressing cylindrical member 7' into the pipe section 1*a* of the refrigerant line 1, e.g. during assembly. A simple and compact design is achieved.

Figure 4:
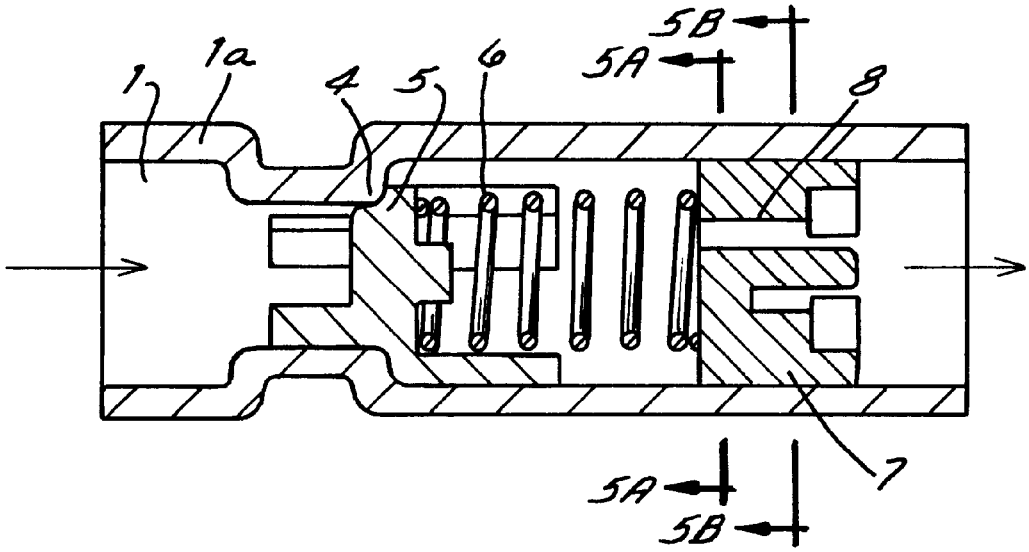
Figure 5A:
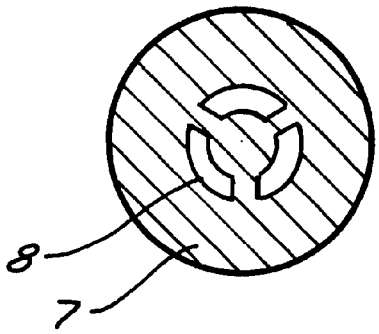
FIG. 5A illustrates a cross-sectional detail view of the embodiment of FIG. 4 in section plane denoted 5A—5A.
Figure 5B:
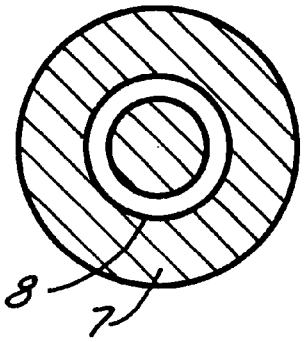
FIG. 5B illustrates a cross-sectional detail view of the embodiment of FIG. 4 in section plane denoted 5B—5B.

In the embodiment of the expansion valve shown in FIG. 4, similar to the embodiment of FIG. 2, exerting force adjusting member 7' is pressed into its proper position into refrigerant passage pipe 1*a* and is fixed to its inner periphery. Here throttling portion 8 does not have the form of a centre bore but is made with a ring-shaped cross-section as shown in FIGS. 5A and 5B. With a ring-shape of the throttling portion 8 the passing sound of the refrigerant is very quiet compared to a throttling portion with the form of a round hole shape. A ring-shaped cross-section of the throttling portion 8 thus provides the advantage of causing no noise source.

Said throttling portion 8 might be formed with a continuous ring-shape as shown in FIG. 5B or can consist of a plurality of separated slots as shown in FIG. 5A. Separated slots are provided in order to form member 7' as one unitary body.

Figure 6:
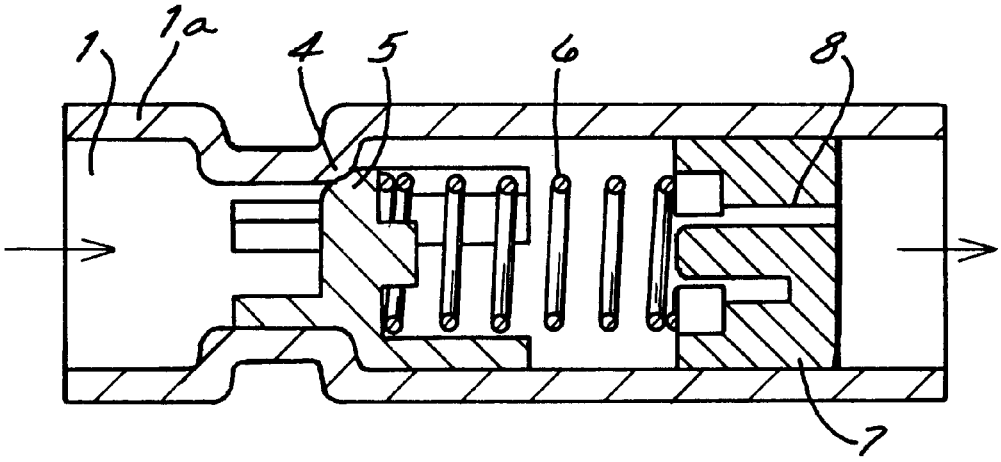
FIG. 6A longitudinal section of a fifth embodiment.

In the embodiment of the expansion valve as shown in FIG. 6 (similar to the embodiment of FIG. 4) in the throttling portion 8 a continuous ring-shaped portion (corresponding to FIG. 5B) is located at the upstream side of the plurality of separated arcuate slots (corresponding to FIG. 5A). This arrangement leads to the same effect as the form of the throttling portion 8 in FIG. 4.

Figure 7:
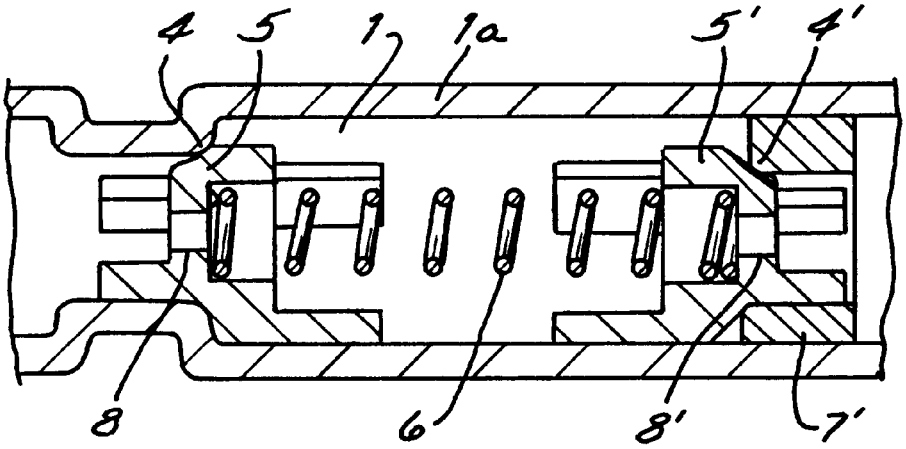
FIG. 7A longitudinal section of a sixth embodiment.

In the embodiment of the expansion valve as shown in FIG. 7 a pair of valve bodies 5, 5' are arranged reversely to each other, and completely the same effect can be obtained even thought the flow of refrigerant may be reversed. This embodiment relates to a so-called bi-directional expansion valve.

Valve seat 4 is formed by throttling the pipe 1*a* itself of the refrigerant line 1. Exerting force adjusting member 7' (a cylindrical body) is pressed in and fixed into pipe 1*a*. Member 7' is formed with valve seat 4' co-operating with the second valve body 5'. Both valve bodies 5, 5' are arranged oppositely with a certain axial interspace between them for co-operation with their associated to valve seats 4, 4'. Between both valve bodies 5, 5' as force exerting means a compression coil spring 6 is provided so that both valve bodies 5, 5' are exerted towards their valve seats 4, 4'. By adjusting the position of pressed in member 7', e.g. during assembly, the magnitude of the discharge amount of the high-pressure refrigerant to be maintained constant can be finely adjusted.

In this embodiment the respective throttling portions 8, 8' are central through holes in both valve bodies 5, 5'. As a result, valve body 5 at the upstream side of the flow of refrigerant performs the discharge control of the refrigerant and throttling portion 8' formed in valve body 5' at the downstream side is acting as the flow restrictor for adiabatic expansion of the refrigerant towards the evaporator. The expansion valve of FIG. 7 is a so-called bi-directional expansion valve.

Figure 8:
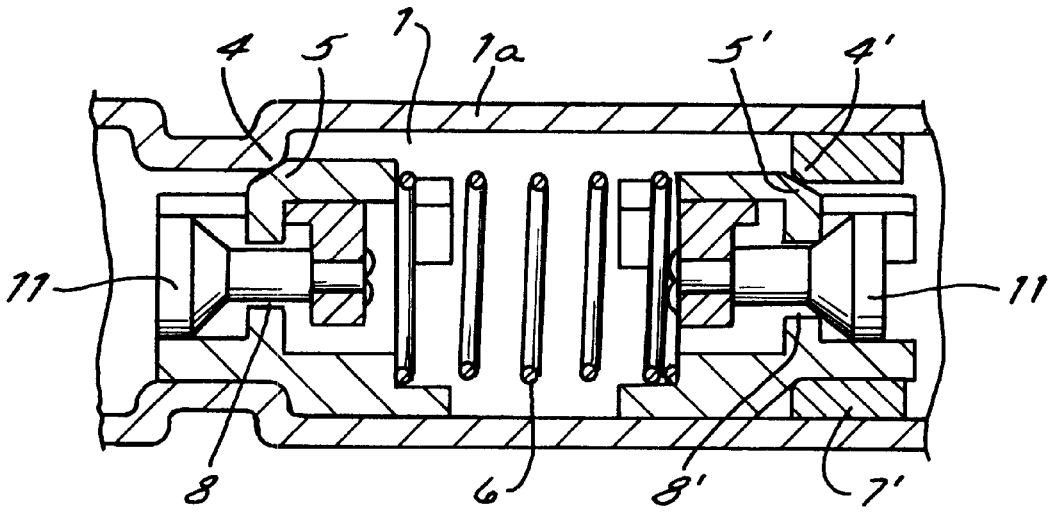
FIG. 8A longitudinal section of a seventh embodiment.
Figure 9:
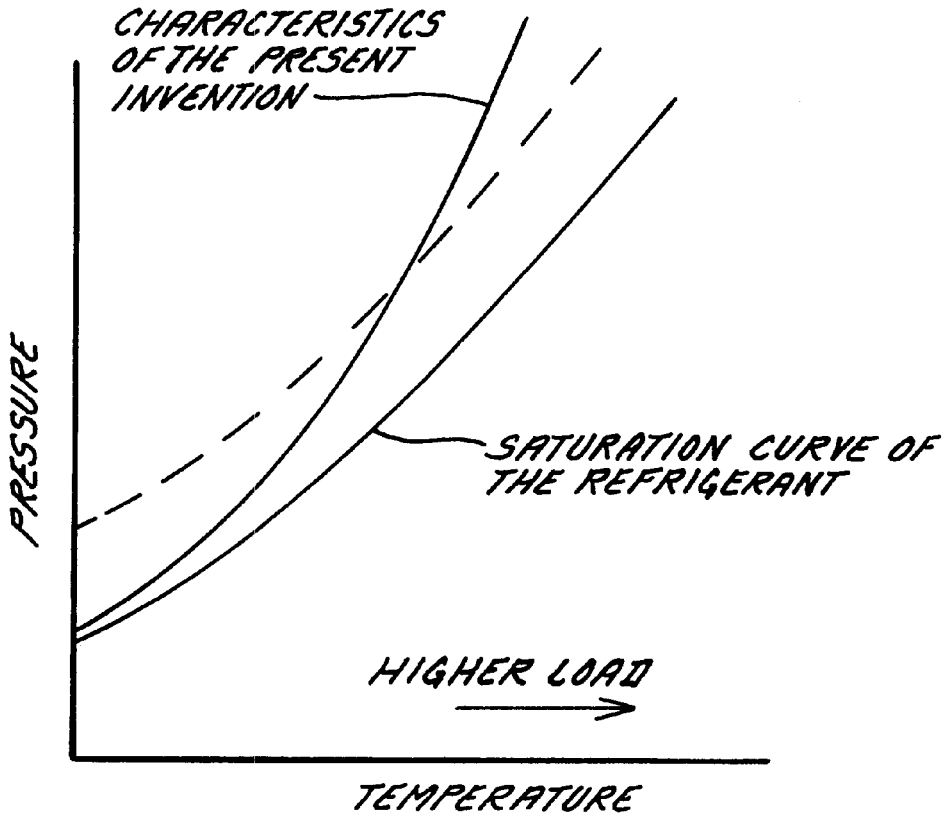
FIG. 9A temperature/pressure characteristic diagram illustrating the degree-of-supercooling of the refrigerant by the expansion valve of at least one of the preceding embodiments.

The embodiment shown in FIG. 8 is also a bi-directional expansion valve. In each throttling portion 8, 8' provided in the respective valve bodies 5, 5' furthermore a check valve 11 is arranged blocking the flow from the outer side against the mouth of each throttling portion 8, thereby restricting the inflow of refrigerant from the outside into each throttling portion 8, 8'. Blocking throttling portion 8 at the upstream side avoids a leakage flow of refrigerant. Both check valves 11 are operating automatically. They have a valve body co-operating with a valve seat defined by the mouth of the associated to throttling portion 8, 8'. The valve bodies are guided by foot pieces 5*a*. The position of press-in exerting force adjusting member 7' determines the exerting force for both valve bodies 5, 5'.

As already mentioned, by using a force exerting means 6 (compression coil spring) having a spring constant which varies in response to the temperature so that a temperature rise generates a larger spring constant by using the shape memorising alloy as the material for spring 6, the degree-of-supercooling controlled constantly increases when a load for the refrigerating cycle is large and the temperature of the refrigerant is rising. In consequence, the degree-of-supercooling controlled constantly increases as the load becomes larger and the cooling power becomes larger thereby permitting to adapt the cooling to the outside conditions.

Forming either the throttling portion 8, 8' or valve seat 4, 4' with the exerting force adjusting member 7, 7' allows to achieve a very simple, compact configuration. By using the exerting force adjusting member to set the exerting force by selectively varying the axial position of the member a fine adjustment can be performed easily when setting the degree-of-supercooling of the high-pressure refrigerant at the upstream side which should be maintained constant and should be controlled. If the force exerting means is constituted by a spring 6 move from a shape memorising alloy so that the spring constant of the spring increases in response to a temperature rise, the degree-of-supercooling can be controlled more constantly. If the load becomes larger, it can be made much higher to intensify the cooling power, thereby adapting the cooling power corresponding to the surrounding conditions.

What is claimed is:

1. An expansion value for controlling the degree of supercooling comprising:

a valve seat in a refrigerant passage upstream of a throttling portion formed by thinly throttling the middle of the refrigerant passage through which a refrigerant is sent to an evaporator;

a valve body for closing/opening said refrigerant passage arranged opposite to said valve seat in a state of an exerting force from a downstream side of said valve seat by force exertion means, said refrigerant being subjected to adiabatic expansion in a state where the degree of supercooling upstream of said valve seat becomes constant and said refrigerant is sent towards said evaporator; and and exertion force adjusting member for finely adjusting the exertion force of said force exertion means, said exertion force adjusting member being formed with said throttling portion and being forced as a press-in member pressed in axially and fixed to and retained in an inner periphery of said refrigerant passage by a press-fit in axial direction in a proper position to adjust the exertion force to a desired value.

2. An expansion valve for controlling the degree of supercooling comprising:

a valve seat in a refrigerant passage upstream of a throttling portion formed by thinly throttling the middle of the refrigerant passage through which a refrigerant is sent to an evaporator;

a valve body for closing/opening said refrigerant passage arranged opposite to said valve seat in a state of an exerting force from a downstream side of said valve seat by force exertion means, said refrigerant being subjected to adiabatic expansion in a state where the degree of supercooling upstream of said valve seat becomes constant and said refrigerant is sent towards said evaporator; and an exertion force adjusting member for finely adjusting the exertion force of said force exertion means, said exertion force adjusting member being formed with said valve seat and being formed as a press-in member pressed in axially and fixed to and retained in the inner periphery of said refrigerant passage by a press-fit in axial direction in a proper position to adjust the exertion force to a desire value.

3. An expansion valve for controlling the degree of supercooling comprising:

a valve seat in a refrigerant passage upstream of a throttling portion formed by thinly throttling a middle portion of the refrigerant passage through which a refrigerant is sent to an evaporator;

a valve body for closing/opening said refrigerant passage arranged opposite to said valve seat in a state of an exerting force from a downstream side of said valve seat by force exertion means, said refrigerant being subjected to adiabatic expansion in a state where the degree of supercooling upstream of said valve seat becomes constant and said refrigerant is sent towards said evaporator;

an exertion force adjusting member of said force exertion means situated within said refrigerant passage with axial distance from said valve seat; and wherein said valve seat is formed by a narrowed section of a pipe of a refrigerant line, said narrowed section being made by pressing deformation of said pipe, said exertion force adjusting member being formed as a disk-shaped press-in member directly pressed axially into said pipe and fixed to an inner periphery of said pipe by a press-fit in axial direction in a proper position to adjust the exertion force to a desired value.

4. An expansion valve as in claim 3, wherein said exertion force adjusting member is formed with said throttling portion.

5. An expansion valve as in claim 4, wherein said exertion force adjusting member is formed with a second valve seat, said second valve seat and said valve seat axially facing each other with a distance between the second valve seat and the valve seat determined by a selected axial position of said exertion force adjusting member, and said valve body and a second valve body associated with the valve seat and the second valve seat, respectively, within the distance between said valve seat and said second valve seat, and a common force exertion means interposed between said valve body and said second valve body for exerting each valve body in a blocking direction towards the associated valve seat, each valve body being formed with a throttling portion.

6. An expansion valve as in claim 5, wherein each of said valve bodies contains an automatically openable check valve received within said throttling portion and blocking in flow direction from the respective valve seat towards said force exerting means.

7. An expansion valve as in claim 3, wherein said force exertion means is a spring made from a shape memorizing alloy providing a temperature depending variable spring constant responsive to a temperature rise of said refrigerant in said refrigerant pipe by a spring constant increase to constantly increase the degree of supercooling with the rise of the temperature of said refrigerant.

8. An expansion valve for controlling the degree of supercooling comprising:

a valve seat in a refrigerant passage upstream of a throttling portion formed by thinly throttling a middle portion of the refrigerant passage through which a refrigerant is sent to an evaporator;

a valve body for closing/opening said refrigerant passage arranged opposite to said valve body seat in a state of an exerting force from a downstream side of said valve seat by force exerting means, said refrigerant being subjected to adiabatic expansion in a state where the degree of supercooling upstream of said valve seat becomes constant and said refrigerant is sent towards said evaporator;

an exertion force adjusting member of said force exerting means situated within said refrigerant passage; and wherein said exertion force adjusting member is formed as a press-in member pressed in axially into a pipe of a refrigerant line and is fixed to an inner periphery of said pipe by a press-fit in axial direction in a proper position to adjust the exertion force to a desired value, said exertion force adjusting member being formed with said valve seat, and wherein a disk-shaped counterfort for said force exerting means is axially fixed in a position by direct pressing deformation of said pipe around said disk-shaped counterfort, said disk-shaped counterfort being formed with said throttling portion.

9. An expansion valve as in claim 8, wherein said force exertion means is a spring made from a shape memorizing alloy providing a temperature depending variable spring constant responsive to a temperature rise of said refrigerant in said refrigerant pipe by a spring constant increase to constantly increase the degree of supercooling with the rise of the temperature of said refrigerant.

* * * * *